US010458412B2

(12) United States Patent
Jin et al.

(10) Patent No.: US 10,458,412 B2
(45) Date of Patent: Oct. 29, 2019

(54) HERMETIC COMPRESSOR HAVING A THERMAL ACTIVATED VALVE

(71) Applicant: LG ELECTRONICS INC., Seoul (KR)

(72) Inventors: Honggyun Jin, Seoul (KR); Sangwoo Joo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 195 days.

(21) Appl. No.: 15/432,032

(22) Filed: Feb. 14, 2017

(65) Prior Publication Data

US 2017/0241419 A1 Aug. 24, 2017

(30) Foreign Application Priority Data

Feb. 24, 2016 (KR) ..... 10-2016-0022077

(51) Int. Cl.
*F04C 28/26* (2006.01)
*F04C 28/28* (2006.01)
(Continued)

(52) U.S. Cl.
CPC ..... *F04C 29/04* (2013.01); *F04C 18/0215* (2013.01); *F04C 28/26* (2013.01);
(Continued)

(58) Field of Classification Search
CPC ..... G05D 23/10; F04C 29/04; F04C 29/0085; F04C 29/12; F04C 18/0215; F04C 28/26; F04C 28/28
(Continued)

(56) References Cited

U.S. PATENT DOCUMENTS 2,505,321 A * 4/1950 Brutocao ..... F16K 17/00 236/61
5,263,643 A * 11/1993 Wells ..... F04B 39/00 236/48 R
(Continued)

FOREIGN PATENT DOCUMENTS

CN 1401909 3/2003
CN 1629494 6/2005
(Continued)

OTHER PUBLICATIONS

European Search Report dated Jul. 27, 2017.
(Continued)

*Primary Examiner* — Deming Wan
(74) *Attorney, Agent, or Firm* — Ked & Associates LLP

(57) ABSTRACT

A hermetic compressor is provided that may include a casing having an inner space, an orbiting scroll provided in the inner space, a non-orbiting scroll engaged with the orbiting scroll to form compression chambers, a high/low pressure dividing plate that divides the inner space into high and low pressure portions, and an overheat preventing unit coupled to a surface of the dividing plate at the high pressure portion, the overheat preventing unit having a communication hole formed through the dividing plate to communicate the high and low pressure portions, and having a valve spaced from the dividing plate by a predetermined interval to selectively open/close the communication hole according to a temperature variation of the high pressure portion, whereby transfer of a refrigerant temperature of the low pressure portion to the overheat preventing unit through the dividing plate may be prevented, and the compressor may be quickly stopped upon being overheated, thereby being protected from damage.

13 Claims, 6 Drawing Sheets

(51) Int. Cl.

| | |
|---|---|
| ***F04C 29/04*** | (2006.01) |
| ***F04C 18/02*** | (2006.01) |
| ***F04C 29/00*** | (2006.01) |
| ***F04C 29/12*** | (2006.01) |

(52) U.S. Cl.
CPC ..... *F04C 28/28* (2013.01); *F04C 29/0085* (2013.01); *F04C 29/12* (2013.01); *F04C 2240/30* (2013.01)

(58) Field of Classification Search
USPC ..... 236/101 R, 66; 137/493, 855, 856; 418/270, DIG. 1
See application file for complete search history.

(56) References Cited

U.S. PATENT DOCUMENTS

| | | | | |
|---|---|---|---|---|
| 2005/0135939 | A1 | 6/2005 | Kim | |
| 2008/0251138 | A1* | 10/2008 | Wang ..... | B60K 15/03519 137/493 |
| 2015/0118076 | A1 | 4/2015 | Grassbaugh | |

FOREIGN PATENT DOCUMENTS

| | | | | |
|---|---|---|---|---|
| CN | 101205914 | | 6/2008 | |
| CN | 104595196 | | 5/2015 | |
| EP | 1 286 052 | | 2/2003 | |
| JP | 06-026472 | | 2/1994 | |
| KR | 10-1997-0008003 | | 5/1997 | |
| KR | 10-0397561 | | 9/2003 | |
| KR | 10-2007-0000542 | | 1/2007 | |
| KR | 10-1161464 | | 7/2012 | |
| WO | WO 2009017741 | A1 * | 2/2009 | ..... F16K 31/002 |

OTHER PUBLICATIONS

Korean Office Action dated Feb. 28, 2017.
Chinese Office Action dated Jun. 5, 2018.
Korean Notice of Allowance dated May 15, 2017.

* cited by examiner

HERMETIC COMPRESSOR HAVING A THERMAL ACTIVATED VALVE

CROSS-REFERENCE TO RELATED APPLICATION(S)

Pursuant to 35 U.S.C. § 119(a), this application claims priority to Korean Application No. 10-2016-0022077, filed in Korea on Feb. 24, 2016, the contents of which are incorporated by reference herein in its entirety.

BACKGROUND

1. Field

A hermetic compressor, and more particularly, an overheat preventing apparatus for a hermetic compressor are disclosed herein.

2. Background

In general, a hermetic compressor includes a drive motor disposed or provided in an inner space of a hermetic casing to generate a drive force, and a compression unit or device that receives the drive force of the drive motor to compress gas. The hermetic compressor may be overheated due to heat generated from the drive motor and heat generated from the compression unit, and this overheat may mainly cause degradation of efficiency and reliability of the compressor. To solve this problem, the following method is well known. That is, for a type of hermetic compressor having an inner space divided into a low pressure portion and a high pressure portion, refrigerant of the high pressure portion is bypassed into the low pressure portion at the overheating moment to increase a temperature of the low pressure portion, thereby stopping the compressor. A representative example is a scroll compressor.

The scroll compressor is a compressor in which a non-orbiting scroll is disposed or provided in an inner space of a casing and an orbiting scroll is engaged with the non-orbiting scroll to perform an orbiting motion such that a pair of compression chambers each including a suction chamber, an intermediate pressure chamber, and a discharge chamber are formed between a non-orbiting wrap of the non-orbiting scroll and an orbiting wrap of the orbiting scroll. The scroll compressor is widely used in air-conditioning apparatuses, for example, for compression of a refrigerant, by virtue of advantages of obtaining a relatively high compression ratio as compared with other types of compressors, and also obtaining a stable torque through a smooth performance of suction, compression, and discharge strokes of the refrigerant.

Scroll compressors may be classified into a high pressure type and a low pressure type according to a manner of supplying refrigerant into a compression chamber. In the high pressure type scroll compressor, the refrigerant is introduced directly into a suction chamber without passing through an inner space of a casing and then discharged through the inner space of the casing. In this manner, most of the inner space of the casing forms a high pressure portion as a discharge space. On the other hand, in the low pressure type scroll compressor, the refrigerant is indirectly introduced into a suction chamber through an inner space of a casing. In this manner, the inner space of the casing is divided into a low pressure portion as a suction space and a high pressure portion as a discharge space by a high/low pressure dividing plate.

FIG. 1 is a longitudinal sectional view of a low pressure type scroll compressor according to the related art. As illustrated in FIG. 1, the related art low pressure type scroll compressor includes a drive motor 20 disposed or provided in an inner space 11 of a hermetic casing 10 to generate a rotational force, and a main frame 30 installed or provided above the drive motor 20.

An orbiting scroll 40 is provided on an upper surface of the main frame 30 and supported by an Oldham ring 36 to perform an orbiting motion, and a non-orbiting scroll 50 is engaged with an upper side of the orbiting scroll 40 to form a compression chamber P. A rotational shaft 25 is coupled to a rotor 22 of the drive motor 20 and the orbiting scroll 40 is eccentrically coupled to the rotational shaft 25. The non-orbiting scroll 50 is coupled to the main frame 30 in a rotation-restricted state.

A back pressure assembly 60 is coupled to an upper side of the non-orbiting scroll 50 to prevent the non-orbiting scroll 50 from being pushed up due to pressure of the compression chamber P during an operation of the non-orbiting scroll 50. A back pressure chamber 60*a* filled with an intermediate pressure refrigerant is formed in the back pressure assembly 60.

A high/low pressure dividing plate 15 is disposed or provided at an upper side of the back pressure assembly 60 to support a rear surface of the back pressure assembly 60 and simultaneously divide the inner space 11 of the casing 10 into a low pressure portion 11 as a suction space and a high pressure portion 12 as a discharge space. An outer circumferential surface of the high/low pressure dividing plate 15 is closely adhered and welded on an inner circumferential surface of the casing 10, and a vent hole 15*a* that communicates with a discharge opening 54 of the non-orbiting scroll 50 is formed on a central portion of the high/low pressure dividing plate 15.

Unexplained reference numeral 13 denotes a suction pipe, 14 denotes a discharge pipe, 17 denotes a sub bearing, 18 denotes a main bearing, 21 denotes a stator, 21*a* denotes a winding coil, 41 denotes a disk portion of the orbiting scroll, 42 denotes an orbiting wrap, 51 denotes a disk portion of the non-orbiting scroll, 51*a* denotes a scroll-side back pressure hole, 52 denotes the non-orbiting wrap, 53 denotes a suction opening, 61 denotes a back pressure plate, 62*a* denotes a plate-side back pressure hole, and 65 denotes a floating plate.

In the related art scroll compressor, when the drive motor 20 generates a rotational force in response to power applied, the rotational shaft 25 transfers the rotation force of the drive motor 20 to the orbiting scroll 40. Accordingly, the orbiting scroll 40 performs an orbiting motion with respect to the non-orbiting scroll 50 by the Oldham ring 36. In response to this, a pair of compression chambers P are formed between the orbiting scroll 40 and the non-orbiting scroll 50 so as to allow suction/compression/discharge of refrigerant.

In this instance, the refrigerant compressed in the compression chambers P is partially introduced from an intermediate pressure chamber into the back pressure chamber 60*a* through back pressure holes 51*a* and 62*a*. The intermediate pressure refrigerant introduced into the back pressure chamber 60*a* generates back pressure force to push up the floating plate 65 forming the back pressure assembly 60. The floating plate 65 is then closely adhered on a lower surface of the high/low pressure dividing plate 15 such that the high pressure portion 12 and the low pressure portion 11 are divided from each other. Simultaneously, pressure of the back pressure chamber pushes the non-orbiting scroll 50 toward the orbiting scroll 40 to maintain an airtight state of the compression chambers P between the non-orbiting scroll 50 and the orbiting scroll 40.

However, depending on an environment condition of the compressor during the compression process, a temperature of the high pressure portion 12 increases over a preset or predetermined temperature, which may result in an overheat of the entire compressor. When the compressor is overheated, components including the motor may be damaged.

Therefore, the related art high/low pressure dividing plate 15 is provided with an overheat preventing unit 80 that selectively communicates the high pressure portion 12 and the low pressure portion 11 with each other according to a temperature of the high pressure portion 12. For example, a communication hole 15*b* through which the low pressure portion 11 and the high pressure portion 12 communicate with each other is formed adjacent to the vent hole 15*a*. A valve recess 15*c* is recessed into an end portion of a high pressure portion side of the communication hole 15*b* by a predetermined depth and the overheat preventing unit 80 is inserted into the valve recess 15*c*.

The related art overheat preventing unit 80 is provided such that a valve 81 that opens and closes the communication hole 15*b* is supported by a stopper 82. The valve 81 is formed of a bimetal which is thermally deformed according to a temperature difference between the high pressure portion 12 and the low pressure portion 11.

The overheat preventing unit 80 continuously blocks the communication hole 15*b*, as illustrated in FIG. 2A, when the temperature of the high pressure portion 12 is normal. On the other hand, when the temperature of the high pressure portion 12 increases over a preset or predetermined temperature, the valve 81, as illustrated in FIG. 2B, is thermally deformed and opens the communication hole 15*b*, such that the refrigerant of the high pressure portion 12 is leaked into the low pressure portion 11 through a refrigerant hole 81*a* and the communication hole 15*b*. Accordingly, the high temperature refrigerant operates an overload protector 90 disposed in the low pressure portion 11 to stop the compressor, thereby preventing damage to the compressor in advance.

However, the related art overheat preventing unit 80, as aforementioned, is installed or provided in a state that the valve 81, which is thermally deformed according to a temperature difference between the high pressure portion 12 and the low pressure portion 11, is brought into contact directly with the high/low pressure dividing plate 15. However, the valve 81 may be affected by a temperature of the relatively cold low pressure portion 11 due to direct contact with the thin high/low pressure dividing plate 15. Accordingly, even though the temperature of the high pressure portion 12 increases greatly, the valve 81 fails to correctly reflect the temperature of the high pressure portion 12 due to being affected by the temperature of the low pressure portion 11. This results in failing to protect the compressor from the overheat.

Further, in the related art overheat preventing unit 80, as the valve recess 15*c* in which the valve 81 is inserted is recessed into the high/low pressure dividing plate 15 by the predetermined depth such that the valve 81 is installed or provided in the high/low pressure dividing plate 15, the high/low pressure dividing plate 15 becomes much thinner at a portion at which the valve 81 is actually brought into contact. Consequently, the valve 81 is very greatly affected by the temperature of the low pressure portion 11.

Furthermore, as the related art overheat preventing unit 80 is assembled in the casing 10 in a state in which the valve 81 is inserted in the high/low pressure dividing plate 15, a loss cost resulting from a replacement of the entire high/low pressure dividing plate 15 increases when a machining error of the valve recess 15*c*, the communication hole 15*b*, or the valve 81 occurs.

BRIEF DESCRIPTION OF THE DRAWINGS

Embodiments will be described in detail with reference to the following drawings in which like reference numerals refer to like elements, and wherein.

DETAILED DESCRIPTION

Figure 1:
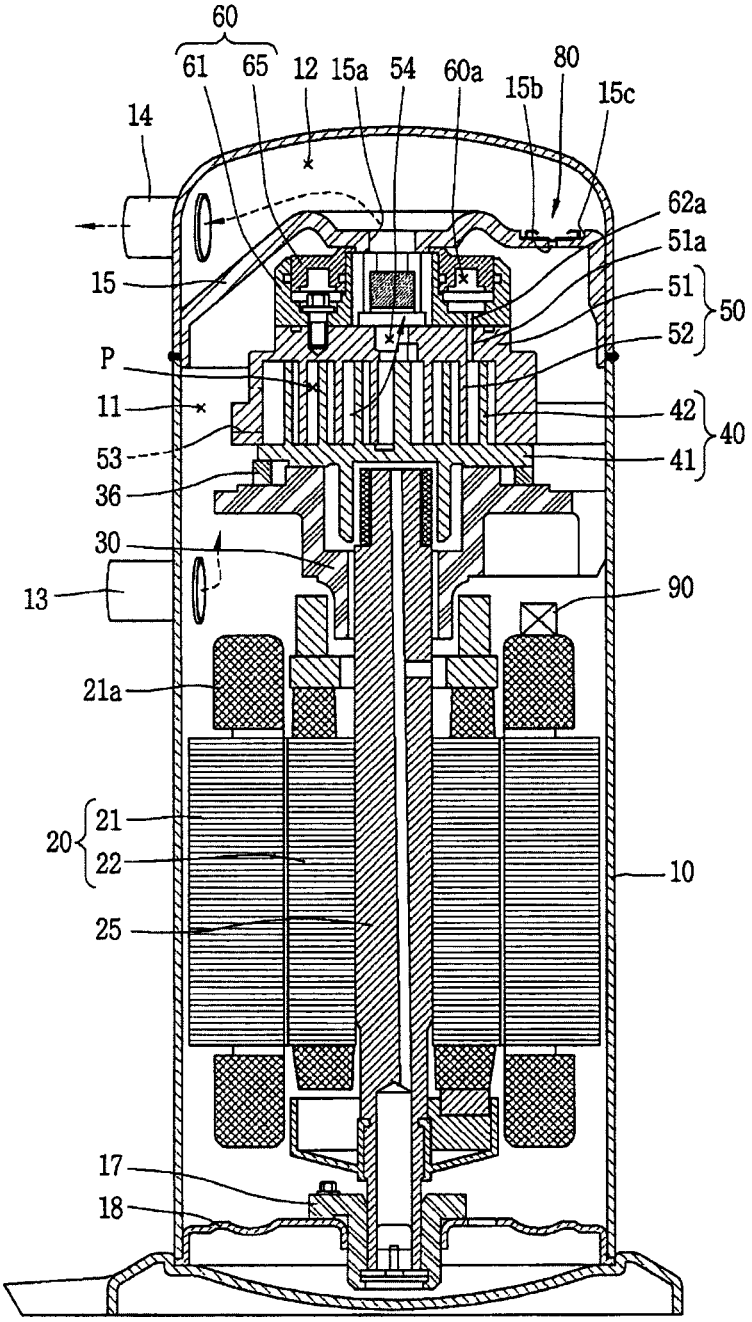
FIG. 1 RELATED ART
FIG. 1 is a longitudinal sectional view of a scroll compressor having an overheat preventing unit according to the related art.
Figure 2A:
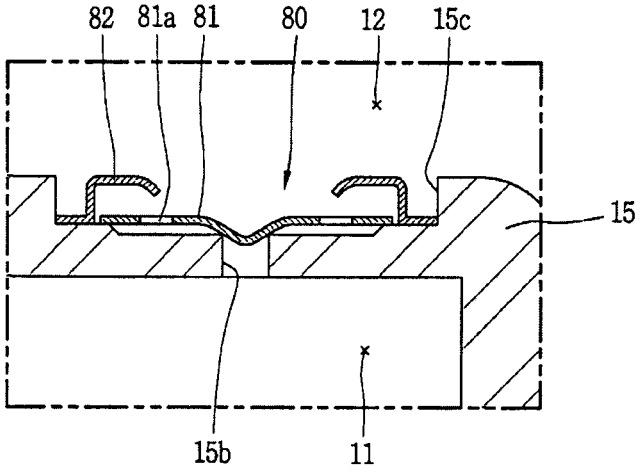
FIG. 2A RELATED ART
FIGS. 2A and 2B are longitudinal sectional views illustrating a closed state and an open state of the overheat preventing unit in the scroll compressor according to FIG. 1.
Figure 2B:
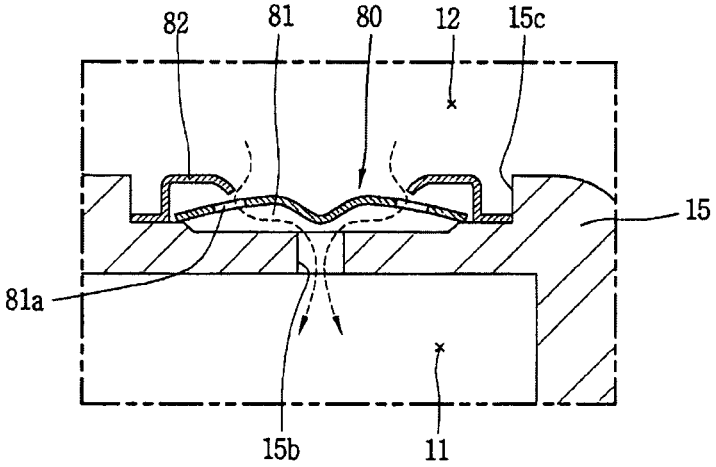
FIG. 2B RELATED ART

Description will now be given in detail of a scroll compressor according to embodiments disclosed herein, with reference to the accompanying drawings. Where possible, like reference numerals have been used to indicate like elements and repetitive disclosure has been omitted.

Figure 3:
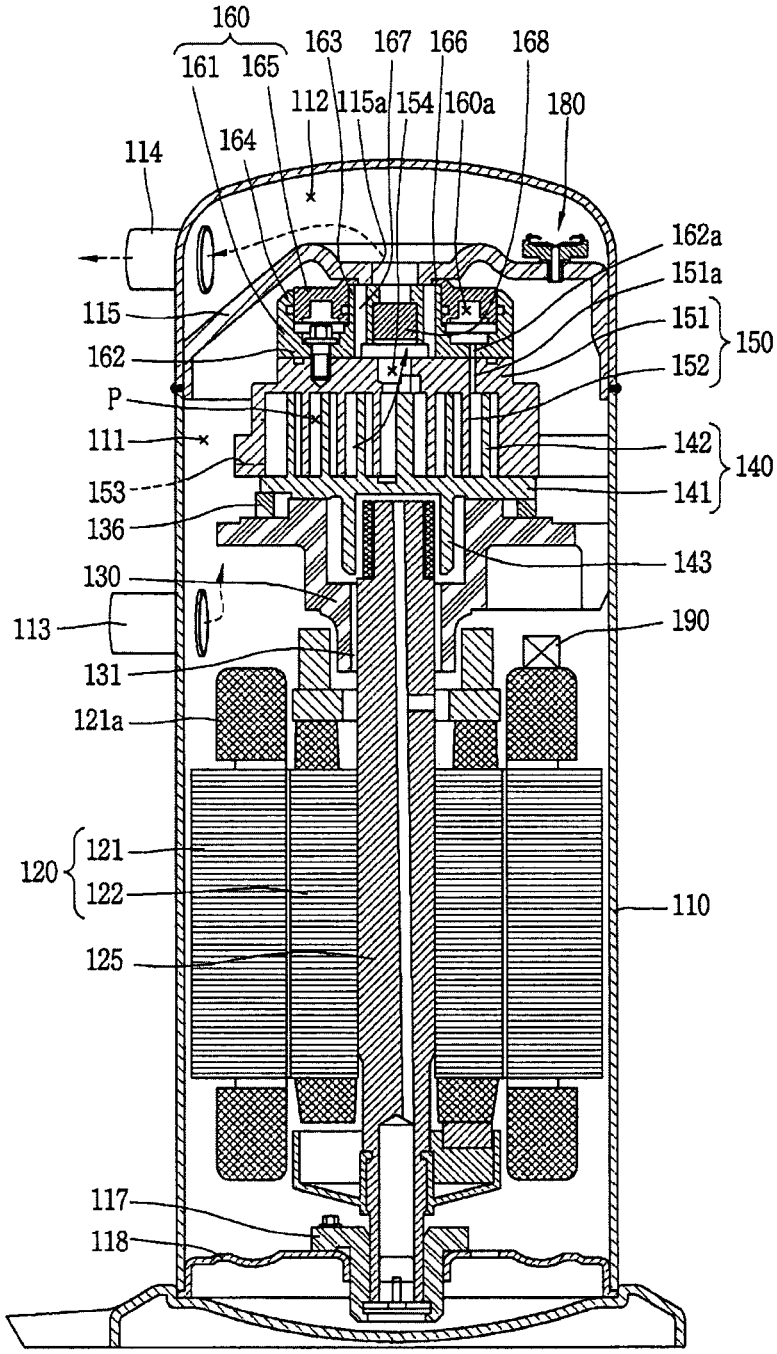
FIG. 3 is a longitudinal sectional view illustrating a scroll compressor having an overheat preventing unit in accordance with an embodiment.
Figure 4:
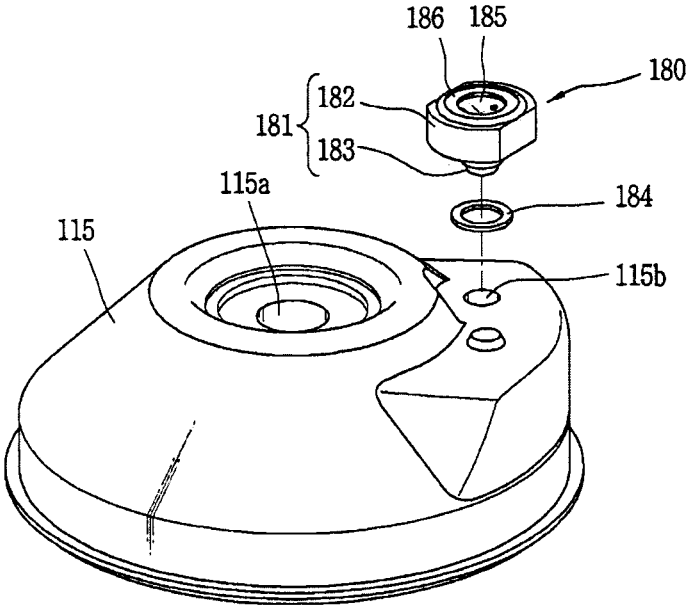
FIG. 4 is a exploded perspective view of the overheat preventing unit according to FIG. 3 disassembled from a high/low pressure dividing plate.
Figure 5A:
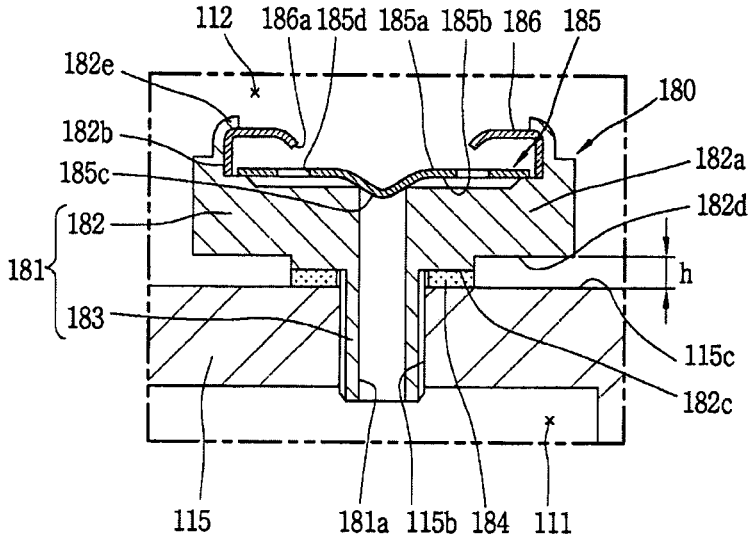
FIGS. 5A and 5B are longitudinal sectional views illustrating a closed state and an open state of the overheat preventing unit in the scroll compressor according to FIG. 3.
Figure 5B:
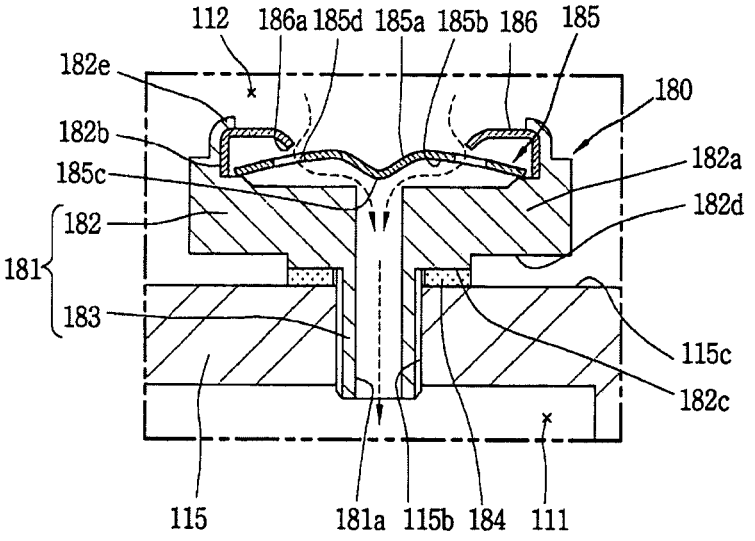
Figure 6:
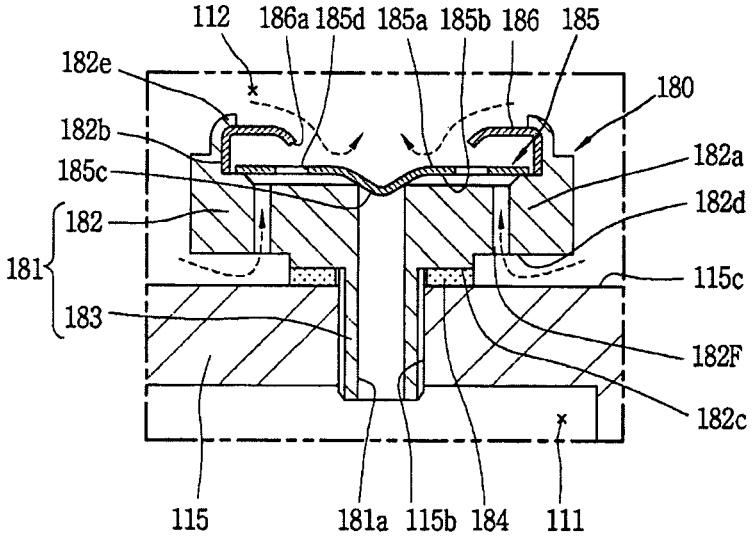
FIG. 6 is a longitudinal sectional view of an overheat preventing unit in accordance with another embodiment.

FIG. 3 is a longitudinal sectional view illustrating a scroll compressor having an overheat preventing unit in accordance with an embodiments. FIG. 4 is a exploded perspective view of the overheat preventing unit according to FIG. 3 disassembled from a high/low pressure dividing plate. FIGS. 5A and 5B are longitudinal sectional views illustrating a closed state and an open state of the overheat preventing unit in the scroll compressor according to FIG. 3. FIG. 6 is a longitudinal sectional view of an overheat preventing unit in accordance with another embodiment.

As illustrated in FIG. 3, a scroll compressor according to this embodiment may include a casing 110 having a hermetic inner space, which may be divided into a low pressure portion 111 as a suction space and a high pressure portion 112 as a discharge space by a high/low pressure dividing plate 115 disposed or provided on or at an upper side of a non-orbiting scroll 150, which is discussed hereinafter. The low pressure portion 111 may correspond to a lower space of the high/low pressure dividing plate 115 and the high pressure portion 112 may correspond to an upper space of the high/low pressure dividing plate 115. A suction pipe 113 that communicates with the low pressure portion 111 and a discharge pipe 114 that communicates with the high pressure portion 112 may be fixed to the casing 110, respectively, such that refrigerant may be introduced into or discharged out of the inner space of the casing 110.

A drive motor 120, which may include a stator 121 and a rotor 122, may be provided in the low pressure portion 111 of the casing 110. The stator 121 may be fixed to an inner wall surface of the casing 110 in a shrink-fitting manner, for example, and a rotational shaft 125 may be coupled to a central portion of the rotor 122 in an insertion manner.

A lower side of the rotational shaft 125 may be rotatably supported by a sub bearing 117 provided in a lower portion of the casing 110. The sub bearing 117 may be supported by a lower frame 118 fixed to an inner surface of the casing 110, to stably support the rotational shaft 125. The lower frame 118 may be, for example, welded on the inner wall surface of the casing 110. A bottom surface of the casing 110 may be used as an oil storage space. The oil stored in the oil storage space may be delivered to an upper side by the rotational shaft 125, for example, so as to be evenly supplied into the casing 110.

An upper end portion of the rotational shaft 125 may be rotatably supported by a main frame 130. The main frame 130 may be fixed to the inner wall surface of the casing 110 together with the lower frame 118. A main bearing 131 may downwardly protrude from a lower surface of the main frame 130, and the rotational shaft 125 may be inserted into the main bearing 131. An inner wall surface of the main bearing 131 may serve as a bearing surface and support the rotational shaft 125 together with the oil such that the rotational shaft 125 may smoothly rotate.

An orbiting scroll 140 may be disposed or provided on an upper surface of the main frame 130. The orbiting scroll 140 may include a disk portion 141 having an approximately disk-like shape, and an orbiting wrap 142 formed in a spiral shape on one side surface of the disk portion 141. The orbiting wrap 142 may form compression chambers P together with a non-orbiting wrap 152 of a non-orbiting scroll 150, which is discussed hereinafter.

The disk portion 141 of the orbiting scroll 140 may orbit in a state of being supported by the upper surface of the main frame 130. An Oldham ring 136 may be interposed between the disk portion 141 and the main frame 130 to prevent rotation of the orbiting scroll 140.

A boss 143 into which the rotational shaft 125 may be inserted may be formed on a lower surface of the disk portion 141 of the orbiting scroll 140. Accordingly, a rotational force of the rotational shaft 125 may make the orbiting scroll 140 perform an orbiting motion.

The non-orbiting scroll 150 engaged with the orbiting scroll 140 may be disposed or provided on an upper portion of the orbiting scroll 140. The non-orbiting scroll 150 may be installed or provided to be movable up and down with respect to the orbiting scroll 140. The non-orbiting scroll 150 may be placed on the upper surface of the main frame 130 in a state in which a plurality of guide pins (not illustrated) provided at the main frame 130 are inserted into a plurality of guide holes (not illustrated) formed on an outer circumference of the non-orbiting scroll 150.

The non-orbiting scroll 150 may include a disk portion 151 formed in a disk-like shape on an upper surface of a body thereof, and the non-orbiting wrap 152 formed in a spiral shape on a lower portion of the disk portion 151 to be engaged with the orbiting wrap 142 of the orbiting wrap 140. A suction opening 153 through which refrigerant existing in the low pressure portion 111 may be introduced may be formed through a side surface of the non-orbiting scroll 150, and a discharge opening 154 through which refrigerant compressed may be discharged may be formed through an approximately central portion of the disk portion 151.

As discussed above, the orbiting wrap 142 and the non-orbiting wrap 152 may form a plurality of compression chambers P. While the compression chambers orbit toward the discharge opening 154, volumes of the compression chambers P may be reduced and thus the refrigerant may be compressed. Accordingly, a compression chamber adjacent to the suction opening 153 may have a lowest pressure, a compression chamber communicating with the discharge opening 154 may have a highest pressure, and a compression chamber existing between the aforementioned compression chambers may have an intermediate pressure with a value between a suction pressure of the suction opening 153 and a discharge pressure of the discharge opening 154. The intermediate pressure may be applied to a back pressure chamber 160*a*, which is discussed hereinafter, to press the non-orbiting scroll 150 toward the orbiting scroll 140. Therefore, a scroll-side back pressure hole 151*a* which communicates with one of regions with the intermediate pressure and through which refrigerant may be discharged may be is formed through the disk portion 151.

A back pressure plate 161 forming a part or portion of a back pressure assembly 160 may be fixed to a top of the disk portion 151 of the non-orbiting scroll 150. The back pressure plate 161 may be provided with a support plate 162 formed in an approximately annular shape and brought into contact with the disk portion 151 of the non-orbiting scroll 150. The support plate 162 may have an annular shape with a center open and a plate-side back pressure hole 162*a* that communicates with the scroll-side back pressure hole 151*a* may be formed through the support plate 162.

First and second annular walls 163 and 164 may be formed on an upper surface of the support plate 162 to surround inner and outer circumferential surfaces of the support plate 162. An outer circumferential surface of the first annular wall 163, an inner circumferential surface of the second annular wall 164 and an upper surface of the support plate 162 may form the back pressure chamber 160*a* formed in an annular shape.

A floating plate 165 forming an upper surface of the back pressure chamber 160*a* may be disposed or provided above the back pressure chamber 160*a*. A sealing end portion 166 is provided on an upper end portion of an inner space of the floating plate 165. The sealing end portion 166 may upwardly protrude from a surface of the floating plate 165 and have an inner diameter which is not so long as to obscure a middle discharge opening 167. The sealing end portion 166 may be brought into contact with a lower surface of the high/low pressure dividing plate 115 to seal the discharged refrigerant, such that the refrigerant may be discharged into the high pressure portion 112 without being leaked into the low pressure portion 111.

Unexplained reference numeral 168 denotes a check valve.

The scroll compressor according to this embodiment may operate as follows.

That is, when power is applied to the stator 121, the rotational shaft 125 may rotate. In response to the rotation of the rotational shaft 125, the orbiting scroll 140 coupled to an upper end portion or end of the rotational shaft 125 may perform an orbiting motion with respect to the non-orbiting scroll 150. Accordingly, a plurality of compression chambers P formed between the non-orbiting warp 152 and the orbiting wrap 142 may move toward the discharge opening 154. During the movement, the refrigerant may be compressed.

When the compression chamber P communicates with the scroll-side back pressure hole 151*a* before reaching the discharge opening 154, the refrigerant is partially introduced into the plate-side back pressure hole 162*a* formed through the support plate 162, and accordingly, intermediate pressure may be applied to the back pressure chamber 160*a* formed by the back pressure plate 161 and the floating plate 165.

Accordingly, downward pressure may be applied to the back pressure plate 161 and upward pressure may be applied to the floating plate 165.

As the back pressure plate 161 may be coupled to the non-orbiting scroll 150 by bolts, the intermediate pressure of the back pressure chamber 160*a* may also affect the non-orbiting scroll 150. However, as the non-orbiting scroll 150 cannot move downward due to contact with the disk portion 141 of the orbiting scroll 140, the floating plate 165 may move upward. As the sealing end portion 166 is brought into contact with a lower end portion of the high/low pressure dividing plate 115, the floating plate 165 may prevent the refrigerant from being leaked from the discharge space as the high pressure portion 112 into the suction space as the low pressure portion 111. In addition, the pressure of the back pressure chamber 160*a* may push the non-orbiting scroll 150 toward the orbiting scroll 140, thereby preventing leakage of the refrigerant between the orbiting scroll 140 and the non-orbiting scroll 150.

As such, the compressor may continuously operate in the state that the high pressure portion 112 and the low pressure portion 111 are blocked from each other by the floating plate 165. When a usage environment condition of the compressor changes, a temperature of the discharge space as the high pressure portion 112 may increase over a preset or predetermined temperature. In this instance, several components of the compressor may be damaged due to high temperature.

Considering this, this embodiment may employ an overheat preventing unit 180 on the high/low pressure dividing plate 115. When the temperature of the high pressure portion 112 is equal to or greater than a preset or predetermined temperature, the overheat preventing unit 180 according to this embodiment may communicate the high pressure portion 112 and the low pressure portion 111 with each other such that the refrigerant of the high pressure portion 112 may be leaked into the low pressure portion 111. This leaked hot refrigerant may operate an overload protector 190 provided on an upper end of the stator 121, thereby stopping the compressor. Therefore, the overheat preventing unit 180 may be configured to sensitively react with the temperature of the discharge space.

Considering the fact that the high/low pressure dividing plate 115 is formed of a thin plate material to divide the high pressure portion 112 and the low pressure portion 111, the overheat preventing unit 180 according to this embodiment may be, if possible, spaced apart from the high/low pressure dividing plate 115 by a predetermined interval, to be less affected from the low pressure portion 111 with relatively low temperature. For example, as illustrated in FIG. 4, the overheat preventing unit 180 may be provided with a body 181 separately fabricated and accommodating a valve plate 185 therein, and the body 181 may be coupled to the high/low pressure dividing plate 115. Accordingly, the valve plate 185 may be spaced apart from the high/low pressure dividing plate 115 by a predetermined interval and accordingly can be less affected from the high/low pressure dividing plate 115.

The body 181 may also be formed of a same material as the high/low pressure dividing plate 115, but may be made of a material with a relatively low heat transfer rate, from a perspective of insulation. The body 181 may be provided with a valve accommodating portion 182 having a valve space, and a coupling portion 183 that protrudes from a center of an outer surface of the valve accommodating portion 182 by a predetermined length to couple the body 181 to the high/low pressure dividing plate 115.

The valve accommodating portion 182 may include a mounting portion 182*a* formed in a disk-like shape and having the valve plate 185 mounted on an upper surface thereof, and a side wall portion or side wall 182*b* extending from an edge of the mounting portion 182*a* into an annular shape to form the valve space together with an upper surface of the mounting portion 182*a*. The mounting portion 182*a* may be thicker than the side wall portion 182*b* in thickness. However, when the mounting portion is formed thick, an effect of retaining heat may be generated. Therefore, the mounting portion may alternatively be formed thinner than the side wall portion in thickness in a range of ensuring reliability.

A stepped surface 182*c* supported on the high/low pressure dividing plate 115 may be formed on a lower surface of the mounting portion 182*a*. Accordingly, a lower surface of an outer mounting portion 182*d*, which may be located outside of the stepped surface 182*c* and correspond to a part or portion of the lower surface of the mounting portion 182*a*, may be spaced apart from the upper surface of the high/low pressure dividing plate 115 by a predetermined interval (height) h. Accordingly, a contact area between the body 181 and the high/low pressure dividing plate 115 may be reduced and simultaneously the refrigerant of the discharge space may be introduced between the body 181 and the high/low pressure dividing plate 115, thereby enhancing reliability to that extent.

However, as illustrated in FIGS. 4 to 5B, an insulating material serving as a sealing member, such as a gasket 184, may be provided between the stepped surface 182*c* and the high/low pressure dividing plate 115 so as to prevent a heat transfer between the body 181 and the high/low pressure dividing plate 115. A communication hole 181*a* that provides communication between the high pressure portion 112 and the low pressure portion 111 with each other may be formed from a center of the upper surface of the mounting portion 182*a* to a lower end of the coupling portion 183. A damper (not illustrated), in which a sealing protruding portion 185*c* of the valve plate 185, which is discussed hereinafter, may be inserted, may be formed on or at an inlet end of the communication hole 181*a*, namely, an end portion of the upper surface of the mounting portion 182*a* in a tapering manner.

A support protruding portion 182*e* may be formed on or at an upper end of the side wall portion 182*b*. The support protruding portion 182*e* may be bent after a valve stopper 186 is inserted, so as to support the valve stopper 186. The valve stopper 186 may be formed in a ring shape and provided with a first gas hole 186*a* at a center thereof such that the refrigerant of the high pressure portion 112 always comes in contact with a first contact surface 185*a* of the valve plate 185.

As illustrated in FIG. 6, the mounting portion 182*a* may be provided with at least one second gas hole 182*f* such that the refrigerant of the high pressure portion 112 may come into contact with a second contact surface 185*b* of the valve plate 185. Accordingly, the refrigerant of the discharge space is brought into contact directly with the first contact surface 185*a* of the valve plate 185 through the first gas hole 186*a* and simultaneously brought into contact directly with the second contact surface 185*b* of the valve plate 185 through the second gas hole 182*f*. This may result in reducing a temperature difference between the first contact surface 185*a* and the second contact surface 185*b* of the valve plate 185 and increasing a reaction speed of the valve plate 185.

The valve plate 185 may be made of a bimetal which may be thermally deformed according to a temperature of the high pressure portion 112 to open and close the communication hole 181*a*. The sealing protruding portion 185*c* may protrude from a central portion of the valve plate 185 toward the communication hole 181*a*, and a plurality of refrigerant holes 185*d* through which the refrigerant may flow during an opening operation may be formed around the sealing protruding portion 185*c*.

A thread may be formed on an outer circumferential surface of the coupling portion 183 to be screwed into the coupling hole 115*b* provided on the high/low pressure dividing plate 115. However, in some cases, such coupling may be allowed in a press-fitting manner or welding manner or using an adhesive member.

In the overheat preventing apparatus for the scroll compressor according to this embodiment, when the temperature of the high pressure portion 112 is normal, as illustrated in FIG. 5A, the closed state of the communication hole 181*a* is maintained. However, when the temperature of the high pressure portion 112 increases over a preset or predetermined temperature, as illustrated in FIG. 5B, the valve plate 185 may be thermally deformed to open the communication hole 181*a*, such that the refrigerant of the high pressure portion 112 may be leaked into the low pressure portion 111. Accordingly, the high temperature refrigerant may operate the overload protector 190 provided on the low pressure portion 111 to stop the compressor, thereby preventing the damage to the compressor in advance.

As such, this embodiment may further extend a path along which a low refrigerant temperature of the low pressure portion 111 may be transferred to the valve plate 185 by thermal conductivity through the high/low pressure dividing plate 115. This may result in enhancing an insulating effect, and accordingly, reducing an affection of the temperature of the low pressure portion 111 with respect to the valve plate 185.

On the other hand, the valve plate 185 may be located in the discharge space as the high pressure portion 112 by being spaced apart from the upper surface 115*c* of the high/low pressure dividing plate 115 at the high pressure portion by the predetermined height h. Accordingly, the valve plate 185 may be mostly affected by the temperature of the high pressure portion 112, and thus, sensitive to the increase in the temperature of the high pressure portion 112.

Accordingly, when the temperature of the high pressure portion increases over a preset or predetermined value, the valve plate may be quickly opened, and thus, the refrigerant of the high pressure portion may quickly flow to the low pressure portion through the communication hole. The refrigerant may then operate the overload protector provided in the drive motor, thereby stopping the compressor. Consequently, the overheat preventing unit according to this embodiment may prevent in advance damage to the compressor due to high temperature, by way of accurately reacting with an operation state of the compressor without a distortion.

Meanwhile, the foregoing embodiments have illustratively described the low pressure type scroll compressor, but may equally be applied to any hermetic compressor, in which an inner space of a casing is divided into a low pressure portion as a suction space and a high pressure portion as a discharge space.

Embodiments disclosed herein provide a hermetic compressor, capable of effectively preventing an overload of the compressor by accurately reflecting an overheat of a high pressure portion. Embodiments disclosed herein further provide a hermetic compressor, capable of enhancing reliability of a valve by virtue of a less affection from temperature of a low pressure portion. Embodiments disclosed herein also provide a hermetic compressor, capable of facilitating an assembly process and minimizing a loss cost caused due to a replacement of components when a machining error or the like occurs.

Embodiments disclosed herein provide a hermetic compressor having a high/low pressure dividing plate provided in a hermetic casing and dividing a high pressure portion and a low pressure portion, wherein an overheat preventing unit operating according to temperature may be installed or provided above a surface of the high/low pressure dividing plate with a predetermined interval. The overheat preventing unit may be configured in an integral form and assembled on the high/low pressure dividing plate.

A separate member made of an insulating material may be interposed between the overheat preventing unit and the high/low pressure dividing plate. Also, a plurality of gas holes may be formed through the overheat preventing unit such that both side surfaces of a valve may communicate with the high pressure portion.

Embodiments disclosed herein provide a hermetic compressor that may include a casing having a hermetic inner space, an orbiting scroll provided in the inner space of the casing and performing an orbiting motion, a non-orbiting scroll engaged with the orbiting scroll to form compression chambers, a high/low pressure dividing plate that divides the inner space of the casing into a high pressure portion and a low pressure portion, and an overheat preventing unit coupled to a surface of the high/low pressure dividing plate at the high pressure portion, having a communication hole formed through the high/low pressure dividing plate to communicate the high pressure portion and the low pressure portion with each other, and provided with a valve located with being spaced apart from the high/low pressure dividing plate by a predetermined interval to selectively open and close the communication hole according to a temperature variation of the high pressure portion. The overheat preventing unit may include a body coupled to the high/low pressure dividing plate with the valve accommodated therein.

The body may be provided with a valve space to accommodate the valve therein, and the valve space may communicate with the communication hole. The body may include a valve accommodating portion having the valve space, and a coupling portion protruding from the valve accommodating portion and coupled to the high/low pressure dividing plate in an inserting manner. The communication hole may be formed through the coupling portion.

The valve accommodating portion may be provided with a first gas hole allowing the valve accommodating portion to communicate with the high pressure portion such that one or a first side surface of the valve is brought into contact with the high pressure portion. The valve accommodating portion may be provided with a second gas hole formed, independent of the first gas hole, such that another or a second side surface of the valve is brought into contact with the high pressure portion.

The valve accommodating portion may include a mounting portion having the valve mounted thereon, and a side wall portion extending from an edge of the mounting portion into an annular shape to form the valve space. At least part or portion of the mounting portion may be spaced apart from the high/low pressure dividing plate by a predetermined interval.

The valve accommodating portion may include a mounting portion having the valve mounted thereon, and a side wall portion extending from an edge of the mounting portion into an annular shape to form the valve space. An insulating material may be interposed between an outer surface of the mounting portion and the high/low pressure dividing plate.

A stepped surface may be formed between the valve accommodating portion and the coupling portion. An insulating material may be interposed between the high/low pressure dividing plate and the overheat preventing unit.

The overheat preventing unit may be provided with a first gas hole and a second gas hole both communicating with the high pressure portion, and the first gas hole and the second gas hole may be formed to face both side surfaces of the valve with interposing the valve therebetween.

Embodiments disclosed herein further provide a hermetic compressor that may include a casing having a hermetic inner space, a space dividing unit or divider that divides the inner space into a suction space and a discharge space, a drive unit or drive disposed or provided in the suction space of the casing and provided with an overload protector, a compression unit or device driven by the drive unit to form a compression space, and allowing refrigerant compressed in the compression space to be discharged into the discharge space, and an overheat preventing unit or preventer disposed or provided on the space separating unit and configured to bypass the refrigerant of the discharge space to the suction space when a temperature of the discharge space increases over a preset or predetermined temperature. The overheat preventing unit may include a body coupled to the space dividing unit, having a communication hole through which the suction space and the discharge space communicate with each other, and provided with a valve space formed in an end portion of the communication hole and communicating with the discharge space, and a valve accommodated in the valve space of the body and selectively opening and closing the communication hole according to the temperature of the discharge space. The body may be provided with a plurality of holes, and the plurality of holes may correspond to both side surfaces of the valve, respectively.

An insulating material may be interposed between an outer surface of the body and an outer surface of the space dividing unit corresponding to the outer surface of the body. A stepped surface may be formed on an outer surface of the body corresponding to the space dividing unit in a manner that a part or portion of the outer surface of the body is spaced apart from the space dividing unit.

In a hermetic compressor according embodiments disclosed herein, a separate overheat preventing apparatus may be assembled on a high/low pressure dividing plate. Accordingly, a valve may not be brought into contact directly with the high/low pressure dividing plate so as to be less affected by temperature of a low pressure portion. This may result in effectively preventing damage to the compressor due to an overheat, which is caused by a sensitive reaction of the valve with a temperature increase of a high pressure portion.

Also, an insulating material may be interposed between the high/low pressure dividing plate and the overheat preventing apparatus so as to further improve an insulating effect. In addition, refrigerant of the high pressure portion may come in contact with both contact surfaces of the valve, thereby enabling a much faster reaction of the valve.

Further scope of applicability will become more apparent from the detailed description given hereinafter. However, it should be understood that the detailed description and specific examples, while indicating embodiments, are given by way of illustration only, since various changes and modifications within the spirit and scope will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hermetic compressor, comprising:

a casing having a hermetic inner space;

a space divider that divides the inner space into a suction space and a discharge space;

a drive provided in the suction space of the casing and provided with an overload protector;

a compression unit driven by the drive to form a compression space, and allowing refrigerant compressed in the compression space to be discharged into the discharge space; and an overheat preventing unit provided on the space divider and configured to bypass the refrigerant of the discharge space to the suction space when a temperature of the discharge space increases over a predetermined temperature, wherein the overheat preventing unit includes:

a body coupled to the space divider, having a communication hole through which the suction space and the discharge space communicate with each other, and provided with a valve space formed in an end portion of the communication hole and communicating with the discharge space;

a valve accommodated in the valve space of the body, wherein the valve selectively opens and closes the communication hole according to the temperature of the discharge space; and a valve stopper coupled to the body and forming the valve space therebetween; and, wherein the body includes:

a mounting portion having the valve mounted thereon;

a side wall extending from an edge of the mounting portion into an annular shape to form the valve space together with an upper surface of the mounting portion and to which the valve stopper is coupled;

a coupling portion that protrudes from a valve accommodating portion and coupled to the space divider in an insertion manner, wherein the communication hole is formed through the coupling portion, and wherein the mounting portion is spaced apart from the space divider by a predetermined interval, wherein the valve stopper is formed with a first gas hole communicating with the discharge space so that a first side of the valve is in contact with the refrigerant of the discharge space, and wherein the mounting portion is formed with a second gas hole communicating with the discharge space so that a second side of the valve contacts the refrigerant of the discharge space.

2. The compressor of claim 1, wherein an insulating material is provided between an outer surface of the body and an outer surface of the space divider corresponding to the outer surface of the body.

3. The compressor of claim 1, wherein a stepped surface is formed on an outer surface of the body corresponding to the space divider in a manner that a portion of the outer surface of the body is spaced apart from the space divider.

4. The overheat preventing unit of claim 1, wherein a support protruding portion is formed at an upper end of the side wall, and wherein the support protruding portion is bent after the valve stopper is inserted, so as to support the valve stopper.

5. An overheat preventing unit for a hermetic compressor, the overheat preventing unit comprising:

a body coupled to a high/low pressure dividing plate that divides an inner space of a casing into a high-pressure portion and a low-pressure portion, the body provided with a communication hole;

a valve stopper coupled to the body and forming a valve space therebetween; and a valve accommodated in the valve space to open and close the communication hole, wherein the body includes:

a mounting portion having the valve mounted thereon;

a side wall extending from an edge of the mounting portion into an annular shape to form the valve space together with an upper surface of the mounting portion and to which the valve stopper is coupled;

a coupling portion that couples to the high/low pressure dividing plate in an insertion manner, wherein the communication hole is formed through the coupling portion, wherein the valve stopper is formed with a first gas hole communicating with a high-pressure portion so that a first side of the valve is in contact with refrigerant of the high-pressure portion, and wherein the mounting portion is formed with a second gas hole communicating with the high-pressure portion so that a second side of the valve contacts the refrigerant of the high-pressure portion.

6. The overheat preventing unit of claim 5, further comprising an insulating material configured to be provided between an outer surface of the body and an outer surface of the high/low pressure dividing plate.

7. The overheat preventing unit of claim 5, wherein a stepped surface is formed on an outer surface of the body corresponding to the high/low pressure dividing plate in a manner that a portion of the outer surface of the body is configured to be spaced apart from the high/low pressure dividing plate.

8. The overheat preventing unit of claim 5, wherein a support protruding portion is formed at an upper end of the side wall, and wherein the support protruding portion is bent after the valve stopper is inserted, so as to support the valve stopper.

9. A hermetic compressor, comprising:

a casing having a hermetic inner space;

an orbiting scroll provided in the inner space of the casing and performing an orbiting motion;

a non-orbiting scroll engaged with the orbiting scroll to form compression chambers;

a high/low pressure dividing plate that divides the inner space of the casing into a high pressure portion and a low pressure portion; and an overheat preventing unit coupled to a surface of the high/low pressure dividing plate at the high pressure portion, the overheat preventing unit having a communication hole formed through the high/low pressure dividing plate to communicate the high pressure portion and the low pressure portion with each other, wherein the communication hole is selectively opened and closed according to a temperature variation of the high pressure portion, wherein the overheat preventing unit includes:

a body coupled to the high/low pressure dividing plate, the body provided with the communication hole;

a valve stopper coupled to the body and forming a valve space therebetween; and a valve accommodated in the valve space to open and close the communication hole, wherein the body includes:

a mounting portion having the valve mounted thereon;

a side wall extending from an edge of the mounting portion into an annular shape to form the valve space together with an upper surface of the mounting portion and to which the valve stopper is coupled;

a coupling portion that protrudes from a valve accommodating portion and coupled to the high/low pressure dividing plate in an insertion manner, wherein the communication hole is formed through the coupling portion, wherein the valve stopper is formed with a first gas hole communicating with the high-pressure portion so that a first side of the valve is in contact with a refrigerant of the high-pressure portion, and wherein the mounting portion is formed with a second gas hole communicating with the high-pressure portion so that a second side of the valve contacts the refrigerant of the high-pressure portion.

10. The compressor of claim 9, wherein at least a portion of the mounting portion is spaced apart from the high/low pressure dividing plate by a predetermined interval.

11. The compressor of claim 9, wherein an insulating material is provided between an outer surface of the mounting portion and the high/low pressure dividing plate.

12. The compressor of claim 9, wherein a stepped surface is formed between the mounting portion and the coupling portion.

13. The overheat preventing unit of claim 9, wherein a support protruding portion is formed at an upper end of the side wall, and wherein the support protruding portion is bent after the valve stopper is inserted, so as to support the valve stopper.

* * * * *